US005465858A

United States Patent [19]

Gargione

[11] Patent Number: 5,465,858

[45] Date of Patent: Nov. 14, 1995

[54] TAMPER-EVIDENT CLOSURE

[75] Inventor: Frank V. Gargione, Egg Harbor, N.J.

[73] Assignee: Comar, Inc., Buena, N.J.

[21] Appl. No.: 386,770

[22] Filed: Feb. 10, 1995

[51] Int. Cl.[6] ..... B65D 41/04

[52] U.S. Cl. ..... 215/252; 215/253

[58] Field of Search ..... 215/252, 253

[56] References Cited

U.S. PATENT DOCUMENTS 4,493,427 1/1985 Wolkonsky ..... 215/252
4,595,110 6/1986 Herr ..... 215/252
4,700,859 10/1987 Gregory ..... 215/252
4,807,712 2/1989 Roy et al. ..... 215/252
5,190,177 3/1993 Collins ..... 215/252

*Primary Examiner*—Allan N. Shoap
*Assistant Examiner*—Robert A. Hylton
*Attorney, Agent, or Firm*—Brady, O'Boyle & Gates

[57] ABSTRACT

A tamper-evident closure having a separate collar and associated locking tabs snapped into a frangible ring connected to the lower end of a cap skirt.

3 Claims, 1 Drawing Sheet

TAMPER-EVIDENT CLOSURE

BACKGROUND OF THE INVENTION

Various tamper-evident closures have been proposed wherein a threaded cap having a skirt portion provided with internal threads for connecting the cap to the threaded neck of a container. A ring is frangibly connected to the lower end of the cap skirt and is provided with a plurality of circumferentially spaced, inwardly and upwardly extending tabs or fingers integrally connected at their lower outer ends to the ring. The upper, inner ends of the tabs are adapted to engage beneath a shoulder or breaker ledge on the neck of the container located below the threaded portion thereof, whereby the cap is prevented from being removed from the container until twisted a sufficient distance to break the frangible connection, thereby separating the cap from the ring. These types of tamper-evident closures are disclosed U.S. Pat. Nos. 4,595,110, dated Jun. 17, 1986, and 4,807,771, dated Feb. 28, 1989.

Instead of molding the cap, frangible ring and tabs as an integral unit, it has been proposed to mold the tabs and frangible ring as an integral unit, which is then telescoped or pressed into or onto the skirt portion of the cap. These types of tamper-evident closures are disclosed in U.S. Pat. Nos. 4,493,427, dated Jan. 15, 1985, and 4,700,859, dated Oct. 20, 1987.

While these tamper-evident closures have been satisfactory for their intended purpose, they have been characterized by certain disadvantages in that the molded tabs are initially vertically oriented and have to be flexed into a semi-horizontal position toward the inside of the closure.

In the tamper-evident closures of the type wherein the integral unit of the frangible ring and tabs are pressed into or onto the skirt portion of the cap, there is a tendency for the integral unit to slip away from the cap before the frangible connection breaks, thereby defeating the tamper-evident feature of the closure.

After considerable research and experimentation, the tamper-evident closure of the present invention has been devised to overcome the disadvantages experienced with prior tamper-evident closures of the types noted above.

SUMMARY OF THE INVENTION

The tamper-evident closure of the present invention comprises, essentially, a threaded cap having a skirt portion provided with internal threads for connecting the cap to the threaded neck of a container, and a ring frangibly connected to the lower end of the cap skirt. A separate collar having a plurality of circumferentially spaced, inwardly and upwardly extending tabs or fingers integrally connected at their lower outer ends to the collar is also provided. The separate collar and associated tabs are snapped into an annular recess provided in the ring. The upper, inner ends of the tabs are adapted to engage beneath a shoulder or breaker ledge on the neck of the container, whereby the cap is prevented from being removed from the container until twisted a sufficient distance to break the frangible connection, thereby separating the cap from the ring and associated tab carrying collar.

By this construction and arrangement, the collar and associated tabs are snapped into and retained within the annular recess in the ring to thereby prevent tampering therewith. The collar does not need to be connected to the cap skirt by any secondary fastener such as sonic welding.

It is merely snapped into the annular recess. The tabs are molded so that their initial position is the operative position for use on a particular container, whereby the tabs can be molded to a desired thickness and appropriate angle.

DESCRIPTION OF THE PREFERRED EMBODIMENT

Figure 1:
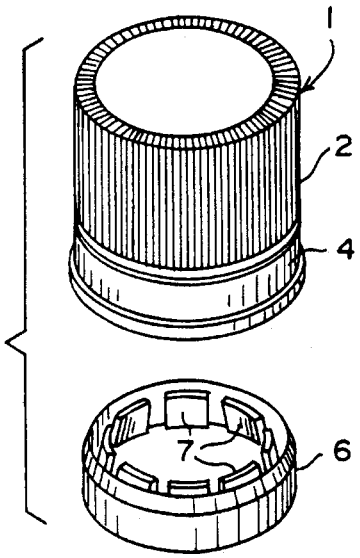
FIG. 1 is an exploded view of the closure and tab collar.
Figure 2:
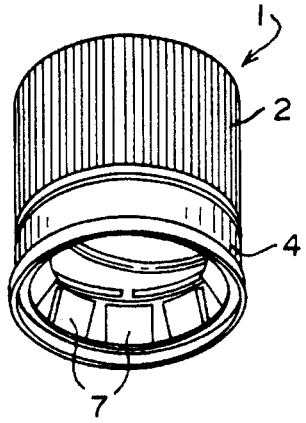
FIG. 2 is a perspective view of the two-piece tamper-evident closure of the present invention.
Figure 3:
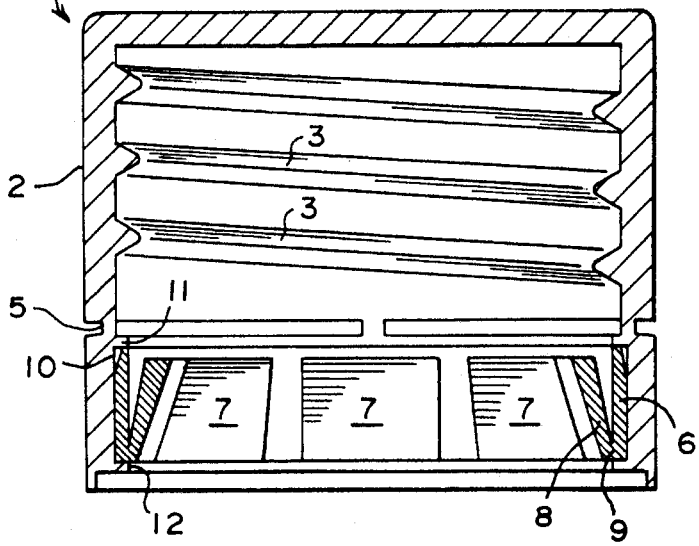
FIG. 3 is an enlarged side elevational view, section, showing the two-piece closure illustrated in FIG. 2.
Figure 5:
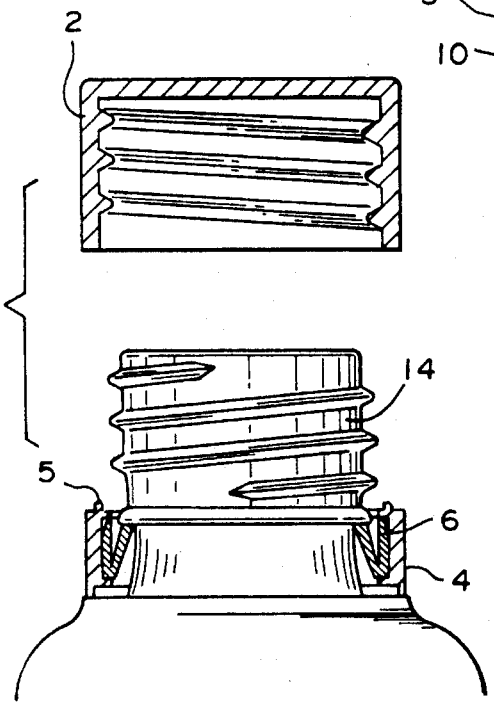
FIG. 5 is a side elevational view, partly in section, showing the cap removed from the frangible ring and associated tab collar.

Referring to the drawings and more particularly to FIGS. 1 and 3, the tamper-evident closure of the present invention comprises a cap 1 having a skirt portion 2 provided with internal threads 3. A ring 4 is frangibly connected to the lower end of the cap skirt as at 5. A separate collar 6 having a plurality of circumferentially spaced, inwardly and upwardly extending tabs or fingers 7 is also provided. The lower outer ends 8 of the tabs 7 are integrally connected to the collar 6 as at 9, and the collar 6 and associated tabs 7 are snapped into a recess 10 provided in the ring 4. The recess 10 is defined by the inner surface of the ring 4 and a pair of axially spaced radially inwardly extending annular shoulders 11 and 12 integral with the inner surface of the ring. By this construction and arrangement, the collar 6 and associated tabs 7 are retained within the recess 10, whereby tampering with the tabs 7 is precluded.

Collar 6 and tabs 7 are integrally molded so that the tabs 7 have a desired thickness, appropriate angle, and initial operative position for use on a particular container.

Figure 4:
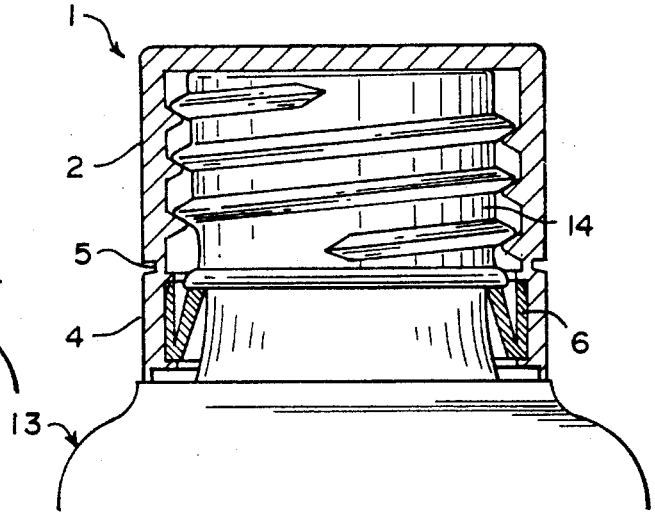
FIG. 4 is a sectional, side elevational view of the two-piece tamper-evident closure threaded onto the neck of a container.

As will be seen in FIG. 4, the collar 6 and tabs 7 are integrally molded so that the tabs 7 have a desired thickness, appropriate angle, and initial operative position for use on a particular container 13 having a threaded neck 14, including a shoulder or breaker ledge 15.

The cap 2 and frangible ring 4 are molded as one piece, and the collar 6 and associated tabs 7 are molded as another piece. To assemble the closure 1, the resiliency of collar 6 allows it to be snapped into and retained within the recess 10. The tamper-evident closure is then threaded onto the neck 14 of a container until the upper ends of the resilient tabs 7 spring inwardly underneath the shoulder 15, to thereby lock the closure 1 on the container 13.

When it is desired to remove the closure, the cap 2 is twisted in a counter-clockwise direction until the axial force imparted to the cap 2 overcomes the tensile strength of the frangible connection 5, whereupon the frangible connection breaks, whereby the cap 2 is separated from the ring 4 and can be unthreaded from the container neck 14.

From the above description, it will be readily apparent to those skilled in the art that the tamper-evident closure is an improvement over heretofore employed tamper-evident closures in that by molding the cap 2 and associated frangible ring 4 as one piece, and molding the collar 6 and associated tabs 7 as another piece, the collar and tab piece can be snapped into various-sized or configured cad and frangible ring units depending upon the type of threaded neck container employed, and the tabs are molded to have an initial desired thickness, appropriate angle and operative position depending upon the particular container.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A tamper-evident closure for a container having a threaded neck portion including a breaker ledge, said closure comprising, a cap having a skirt portion, internal threads provided in said skirt portion, a ring positioned at the lower end of said skirt portion, a frangible connection connecting said ring to the lower end of said skirt portion, a separate annular collar, and a plurality of circumferentially spaced, inwardly and upwardly extending resilient tabs positioned within said collar, the lower outer ends of said tabs being integrally connected to the inner peripheral surface of said collar, said collar and associated tabs being snap fit into said ring, whereby when the closure is threaded onto the neck of the container, the inner upper ends of the resilient tabs being engageable to the lower surface of the breaker ledge to lock the ring, collar and associated tabs on the neck of the container, the frangible connection being broken when the cap is twisted to remove the closure from the neck of the container.

2. A tamper-evident closure according to claim 1, wherein a recess is provided in said ring, said recess being defined by the inner peripheral surfaces of said ring and a pair of axially spaced, radially inwardly extending annular shoulders connected to the inner surface of said ring, the collar and associated tabs being snapped into said recess.

3. A tamper-evident closure according to claim 1, wherein the cap and ring are molded as one piece, and the collar and associated tabs are molded as another piece.

* * * * *